US006134806A

United States Patent [19]

Dhaemers

[11] Patent Number: 6,134,806

[45] Date of Patent: Oct. 24, 2000

[54] BAG WITH AIR DISTRIBUTOR AND OZONE GENERATOR

[76] Inventor: Gregory L. Dhaemers, 108 N. 58th St., Superior, Wis. 54880

[21] Appl. No.: 09/365,793

[22] Filed: Aug. 3, 1999

Related U.S. Application Data

[63] Continuation-in-part of application No. 09/111,440, Jul. 7, 1998, Pat. No. 5,930,915.

[60] Provisional application No. 60/652,487, Sep. 29, 1997, and provisional application No. 60/104,761, Oct. 19, 1998.

[51] Int. Cl.[7] ..... F26B 9/00

[52] U.S. Cl. ..... 34/404; 34/487; 34/516; 34/511; 34/60; 34/622; 34/202; 34/233; 34/235

[58] Field of Search ..... 34/60, 72, 404, 34/418, 427, 437, 443, 467, 487, 516, 618, 619, 621, 622, 202, 218, 233, 235, 511; 422/5, 28, 32, 33, 186.07, 186.09, 291, 294

[56] References Cited

U.S. PATENT DOCUMENTS

| | | | |
|---|---|---|---|
| 3,432,939 | 3/1969 | Eichholz . | |
| 3,487,557 | 1/1970 | Linstead . | |
| 3,513,564 | 5/1970 | Gramprie . | |
| 3,577,650 | 5/1971 | Brahm . | |
| 3,626,602 | 12/1971 | Glowacki . | |
| 3,793,744 | 2/1974 | Saita | 34/104 |
| 3,805,561 | 4/1974 | Bullock . | |
| 3,877,152 | 4/1975 | Gorman . | |
| 3,955,922 | 5/1976 | Moulthrop | 21/102 R |
| 4,145,602 | 3/1979 | Lee . | |
| 4,677,764 | 7/1987 | Cerny . | |
| 4,811,159 | 3/1989 | Foster, Jr. . | |
| 5,141,722 | 8/1992 | Nagashima | 422/292 |
| 5,369,892 | 12/1994 | Dhaemers . | |
| 5,528,840 | 6/1996 | Pajak et al. . | |
| 5,546,678 | 8/1996 | Dhaemers . | |
| 5,713,137 | 2/1998 | Fujita | 34/106 |

*Primary Examiner*—Pamela A. Wilson

[57] ABSTRACT

A portable sport equipment bag having an air distributor is connected with a hose to blower and ozone generator operable to move air and ozone under pressure into the air distributor. The air distributor has one or more manifolds located within the bag. The manifolds have a plurality of holes to allow air and ozone in the manifolds to flow into the bag to dry sport equipment and objects within the bag and destroy bacteria, molds and fungus in the bag. One or more air filters mounted on the bag remove odors and foreign matter from the air flow from the bag into the environment adjacent the bag.

25 Claims, 15 Drawing Sheets

BAG WITH AIR DISTRIBUTOR AND OZONE GENERATOR

CROSS REFERENCE TO RELATED APPLICATION

This application is a continuation-in-part of U.S. application Ser. No. 09/111,440, filed Jul. 7, 1998, now U.S. Pat. No. 5,930,915. application Ser. No. 09/111,440 is a continuation of U.S. Provisional application Ser. No. 60/052,487 filed Sep. 29, 1997 and U.S. Provisional application Ser. No. 60/104761 filed Oct. 19, 1998.

FIELD OF THE INVENTION

The invention is in the field of portable bags having air distributors for air drying clothing, sporting and athletic equipment and ozone generators for removing odors, allergens, bacteria, molds and fungus from the air and equipment in the bag.

BACKGROUND OF THE INVENTION

Damp garments, sport and athletic equipment, boots and shoes have been dried out in storage areas having natural air circulation. Garments and sport equipment that retain water will mold, mildew and have unpleasant odors without adequate removal of water and moisture from the equipment. G. L. Dhaemers in U.S. Pat. No. 5,369,893 discloses several self-contained dryers for accommodating articles, such as clothing, sporting equipment and shoes. The dryers have walls that cause heated air to re-circulate in the drying chambers to decrease the moisture content of the air and increase the drying energy efficiency. Blowers and fans associated with electric heaters operate to circulate heated air through the drying chambers. The dryer shown in FIGS. 23 to 26 of U.S. Pat. No. 5,369,892 is a chest or foot locker structure having a rigid housing. Wheels and a handle attached to the housing are used to facilitate manual movement of the dryer. The top of the housing has a cover movable to an open position to allow access to the drying chamber. A motor driven fan located in an air mixing chamber within the housing draws air through a filter into the drying chamber. Air porous walls within the drying chamber allow air to flow from the drying chamber back to the air mixing chamber for re-circulation back into the drying chamber. Air also flows out of the drying chamber through a filter having activated charcoal to remove odors from the air discharge into the environment. This dryer requires an internal motor and fan associated with an electric heater, and specialized porous walls within a housing. While this dryer is effective to dry articles in the drying chamber it is complex and expensive to manufacture. The travel and sports bag equipped with an air distributor and ozone generator of the invention disclosed in this application is effective in air drying articles without complex and expensive structures.

SUMMARY OF THE INVENTION

The invention is a portable bag, known as a sport bag, having an internal chamber for storing articles, such as clothing, shoes, boots, ice skates, ski boots, sporting equipment and other objects. An air distributor located in the bottom of the chamber directs a plurality of streams of air into the chamber to dry the articles located in the chamber. Air under pressure is supplied to the air distributor with a blower connected to the air distributor positioned in the chamber to supply air to hollow articles, such as gloves, shoes boots and ice skates. One or more air filters mounted on the bag allow air to flow out of the bag and remove odors and particulates from the air. An ozone generator associated with the blower creates ozone which moves with the air into the bag. The ozone functions as an oxidant and germicide in the bag and on equipment in the bag.

The bag is an elongated flexible container having side walls joined to end and bottom walls. The bag is made from canvas, vinyl, or fabric materials which allow it to be folded for storage and expanded for accommodating articles. One or more zippers or hook and loop releaseable fasteners along the top of the bag functions to close the bag and allow access into the bag chamber to facilitate the introduction of articles into the bag chamber and removal of the articles from the bag. A modification of the bag includes side pockets for storing articles, such as shoes, ice skates and mittens. Air is introduced into the side pockets through tubular members mounted on the air distributor to dry the articles in the side pockets. Air filters mounted on the side pockets allow air to flow out of the side pockets and remove odors and particulates from the air. The air from the side pockets can be routed back into the chamber of the bag. The air will be exhausted from the chamber through the air filters mounted on the bag. The bag can have a longitudinal or vertical orientation. A vertical bag has a side wall containing a releaseable closure providing admittance into the interior of the bag. An air distributor located at the bottom of the bag directs air up into the bag chamber to dry articles located within the bag chamber. An external blower discharges air into the air distributor. An ozone generator supplies ozone to the air directed into the air distributor. The ozone along with air is expelled from the air distributor into the bag.

The air distributor has one or more internal chambers for accumulating air under pressure supplied by an external located blower. The blower can be equipped with an electric heater operable to heat the air discharged by the blower into the air distributor. Holes in top wall of the air distributor dispense and spread out the air flow into the bag chamber so as to subject a large number of surfaces of the articles in the bag chamber to flowing air. This increases drying efficiency and reduces damp sections of the articles.

The air distributor has one or more manifolds that fit into the bottom of the bag. The manifolds are generally flat and utilize only a small amount of space in the bag chamber. When two or more manifolds are used for an air distributor they are hinged together to allow articulation between the manifolds. One manifold has an air inlet tube adapted to be coupled to the hose to receive air from the blower.

The moving air in the bag chamber picks up the moisture, foreign matter and odors from the articles stored in the bag chamber. The odors, bacteria, molds and fungus are neutralized by the ozone in the air in the bag chamber. The foreign matter carried by the air is collected by the filters mounted on the bag. The filters have activated carbon or other odor reducing materials that remove odors from the air discharged into the environment.

DESCRIPTION OF PREFERRED EMBODIMENTS

Figure 1:
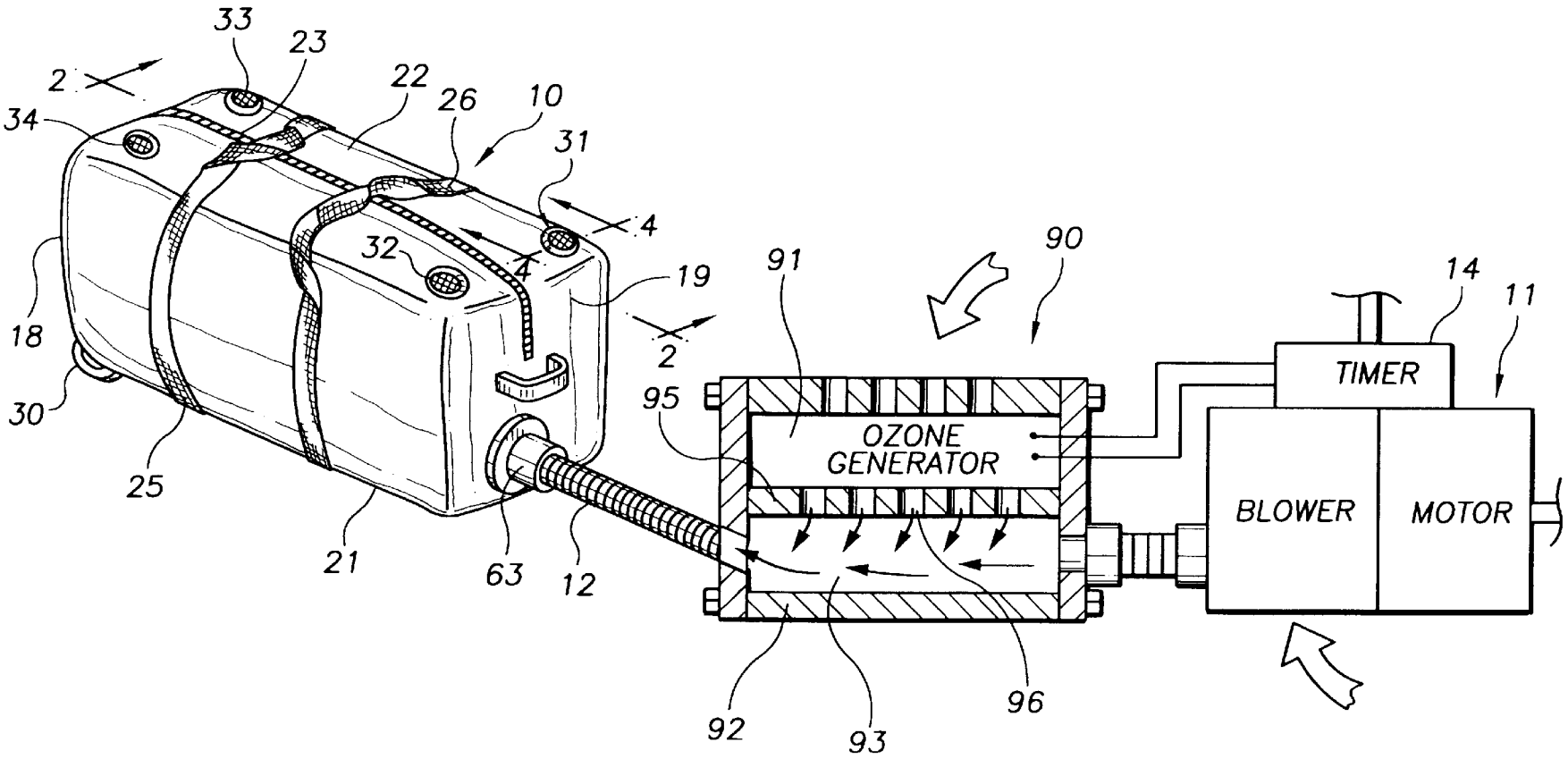
FIG. 1 is a perspective view of a travel and sport bag equipped with the air distributor of the invention connected to an air blower and ozone generator.

A travel and sports bag 10, shown in FIG. 1, is connected to an air blower or pump 11 with an elongated flexible hose 12. Bag 10 is a flexible canvas, plastic, vinyl, or cloth container or grip used to store and carry sports equipment, such as hockey, basketball, soccer, football, tennis, hand ball, and baseball equipment. The equipment stored in bag 10 is at times moist and wet due to the weather and body sweat. Air is moved through bag 10 to dry and deodorize the equipment in the bag. An air blower 11 has an electric motor driving an impeller or fan to force air through an ozone producing unit 90 and hose 12 into an air distributor 44 located along the bottom of bag 10. The air flows out of distributor 44 into the bag chamber 24. The air flowing through bag 10 picks up moisture, foreign matter, and odors from the equipment and is discharged through filters 31–34 mounted on the bag to atmosphere. The ozone moving with the air through bag 10 is a strong oxidizing agent that destroys odors and allergens and kills bacteria, molds and fungus.

Air blower 11 is an electric motor driven pump located within a casing 13. The timer 14 mounted on top of casing 13 controls the operation of the electric motor for a predetermined time and shuts off the motor. Timer 14 also controls the duration of operation of the ozone production module or ozone generator 91. Blower 11 can be equipped with an electric heater whereby hot air is discharged into hose 12 and air distributor 44. A device operable to introduce a mist or vapors into the air intake of blower 11 to mitigate odors in bag chamber 24 and equipment stored therein can be operatively associated with blower 11. This device can be mounted on the blower.

Ozone generator 91 is located in a casing 92 having a passage 93 for carrying air from blower 11 to hose 12. Casing 92 has air inlet openings 94 to allow air to flow to the ozone generator 91. An interior wall 95 having holes 96 open to passage 93 supports ozone generator 91 in easing 92. The air flowing in passage 93 draws air through the ozone generator 91 and into passage 93. The ozone flows with the air into the air distributor which directs the air and ozone into the bag chamber 24 where it functions as an oxidant and germicide. The ozone generator 91 is a conventional ozone producing module which produces ozone by passing through a corona discharge between two parallel or concentric electrodes separated by a dielectric. The oxygen in the air is broken down to charged oxygen atoms which recombine to form molecules of ozone which contain three atoms of oxygen.

Figure 3:
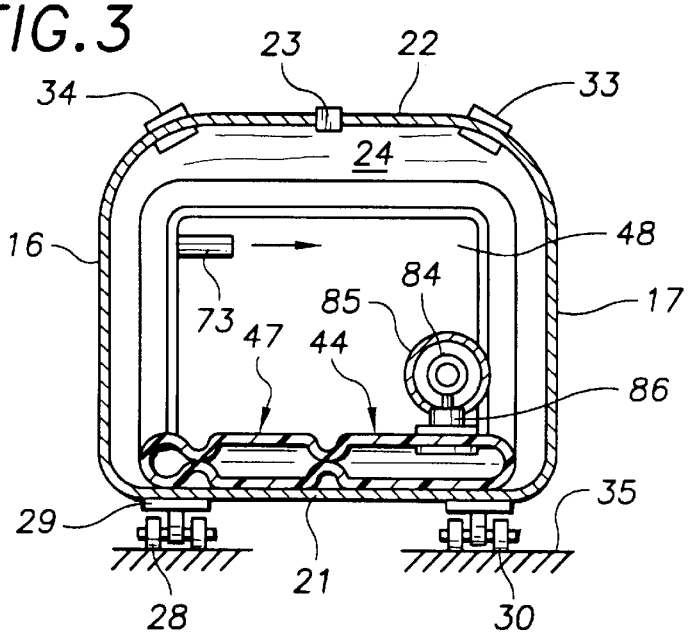
FIG. 3 is a sectional view taken along line 3—3 of FIG. 2.

Bag 11, as seen in FIG. 3, has upright side walls 16 and 17 joined to end walls 18 and 19. Walls 16–19 are joined to a generally flat bottom wall 21. The top wall 22 of bag 10 has a longitudinal zipper or linear releaseable fastener 23 that extends into end walls 18 and 19 to facilitate access to the interior or bag chamber 24 comprising the storage area of bag 10 and allow the equipment to be placed into and removed from bag 10. Bag 10 can be made from canvas, fabric and plastic materials. A pair of straps 25 and 26 are secured to the side walls 16 and 17 of bag 10. The upper portions of straps 25 and 26 extend above top wall 22 of bag 10 and provide handles used to carry the bag. A second handle 27 is secure to end wall 19 to facilitate towing of bag 10. Two sets of wheels 28 and 30 are attached to opposite bottom ends of end wall 18 with brackets 29. Each set of wheels 28, 30 has a pair of rollers rotatable mounted on a transverse axle. Other types of wheels or rollers can be used to provide movable support for bag 10 on surface 35.

Figure 4:
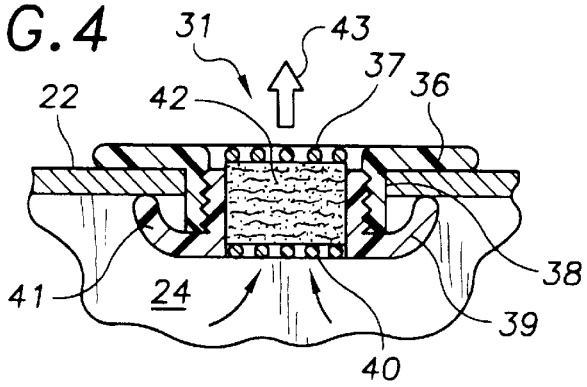
FIG. 4 is an enlarged sectional view taken along line 4—4 of FIG. 1.

Top wall 22 has air filters 31, 32, 33 and 34 in each corner to remove odors and foreign matter from the air allowing air to flow from bag chamber 24 to the atmosphere. The filters absorb odors and collect particulates that are carried by the air. As shown in FIG. 4, filter 31 extends through a hole 38 in top wall 22 and has a cap 36 having a first grid 37 threaded on a holder 39 having a second grid 40. Holder 39 has an annular lip 41 located in firm engagement with top wall 22 to clamp filter 31 on top wall 22. Air filtering materials 42 including activated charcoal, fiber materials, or other odor reducing materials are located within holder 39 to remove odor and foreign matter from the air. Screens on opposite sides of filtering materials 42 cooperate with the grids 37 and 40 to retain filtering materials 42 within holder 39. Filters 32, 33 and 34 have the same structure and function as filter 31. Air within chamber 244 flows through all filters 31–34, as shown by arrows 43, when zipper 23 is closed. The air filters 31, 32, 33, and 34 are removable from their holders to allow the filters to be replaced with new filters. The air filters can be replaceable cartridges accommodating odor removing materials.

Figure 2:
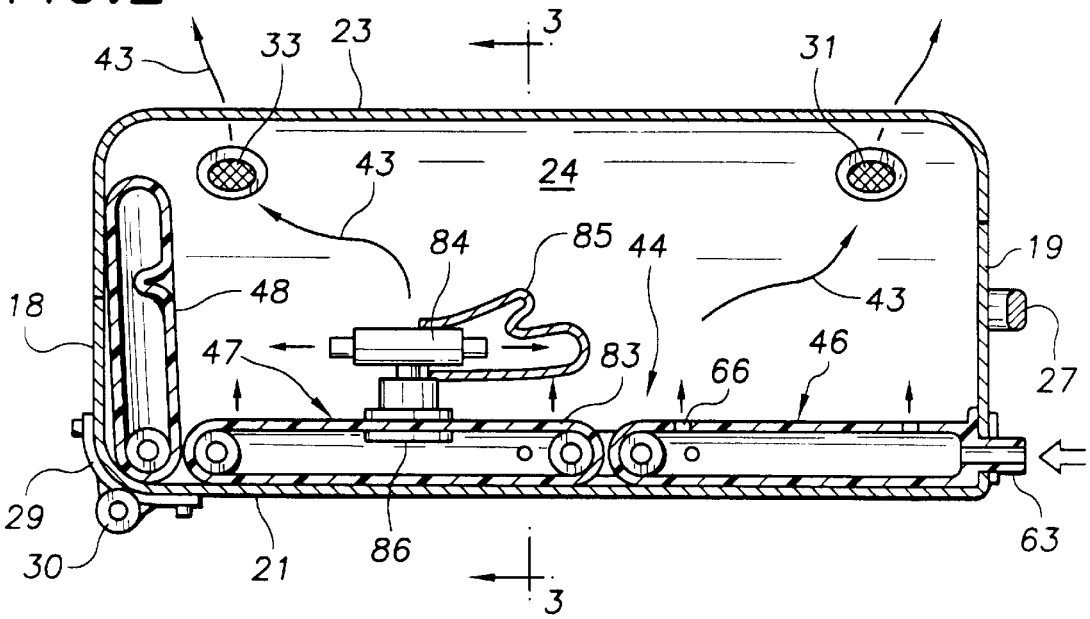
FIG. 2 is an enlarged section view taken along the line 2—2 of FIG. 1.
Figure 5:
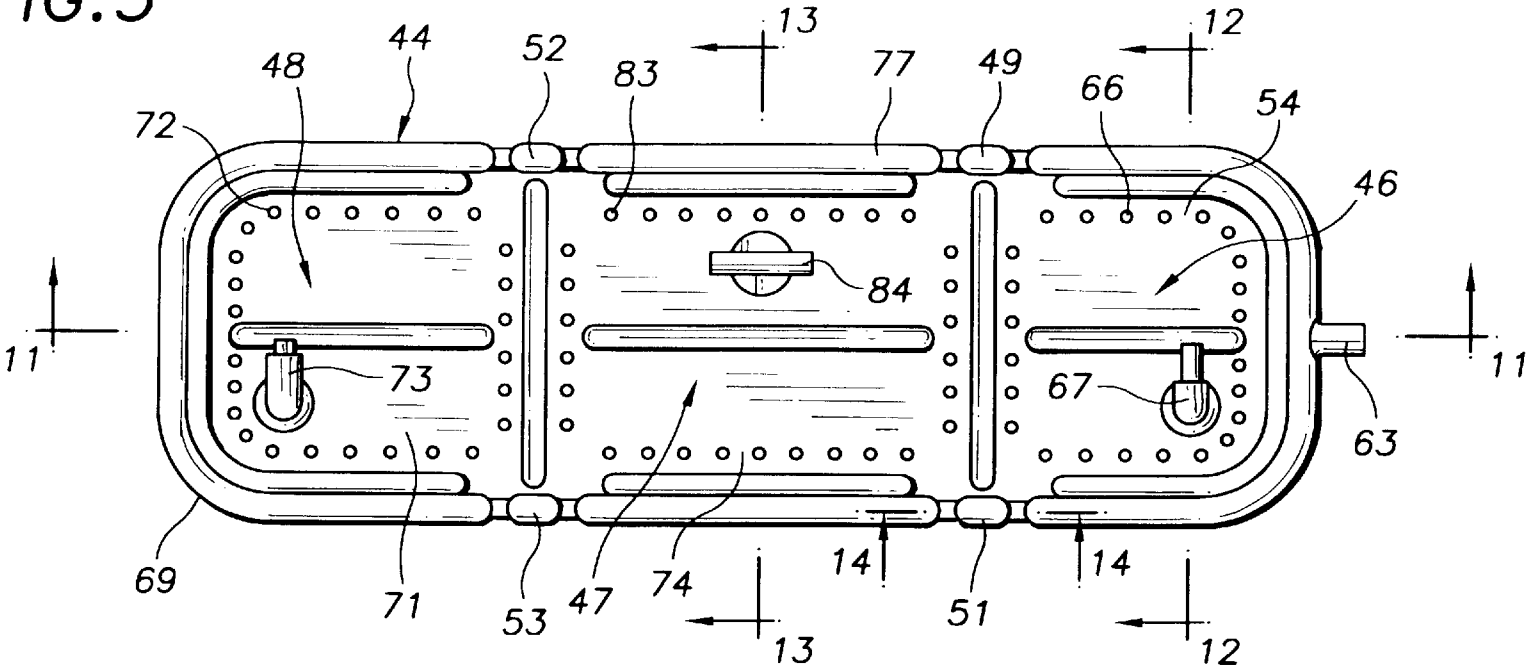
FIG. 5 is a top plan view of the air distributor.
Figure 6:
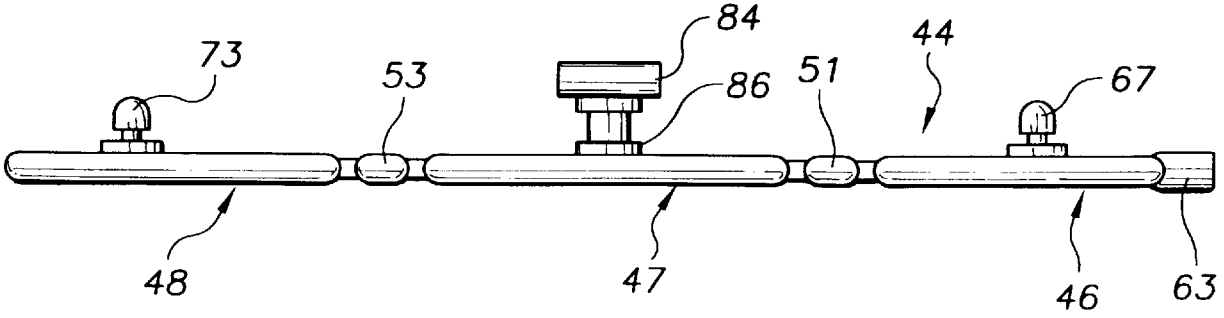
FIG. 6 is a side elevational view of the right side of the air distributor of FIG. 5.
Figure 7:
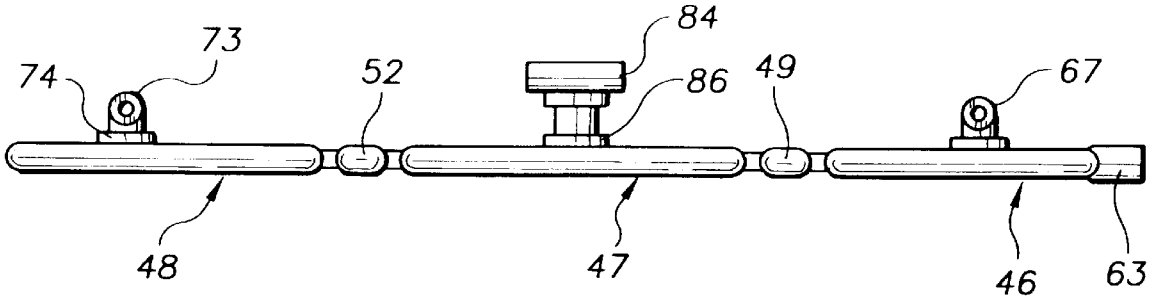
FIG. 7 is a side elevational view of the left side of the air distributor of FIG. 5.
Figure 9:
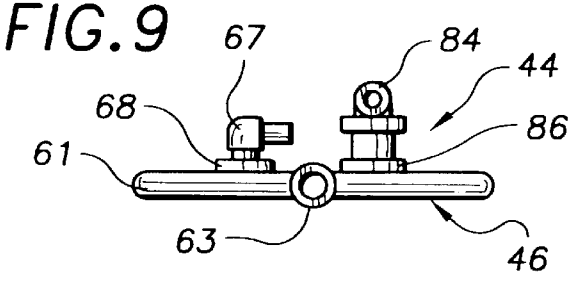
FIG. 9 is an end elevational view of the right end of the air distributor of FIG. 5.
Figure 8:
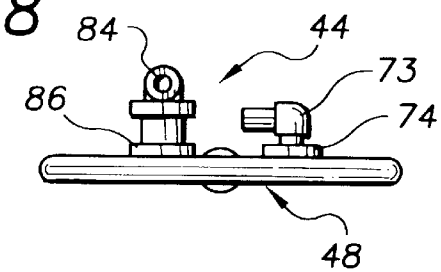
FIG. 8 is an end elevational view of the left end of the air distributor of FIG. 5.
Figure 10:
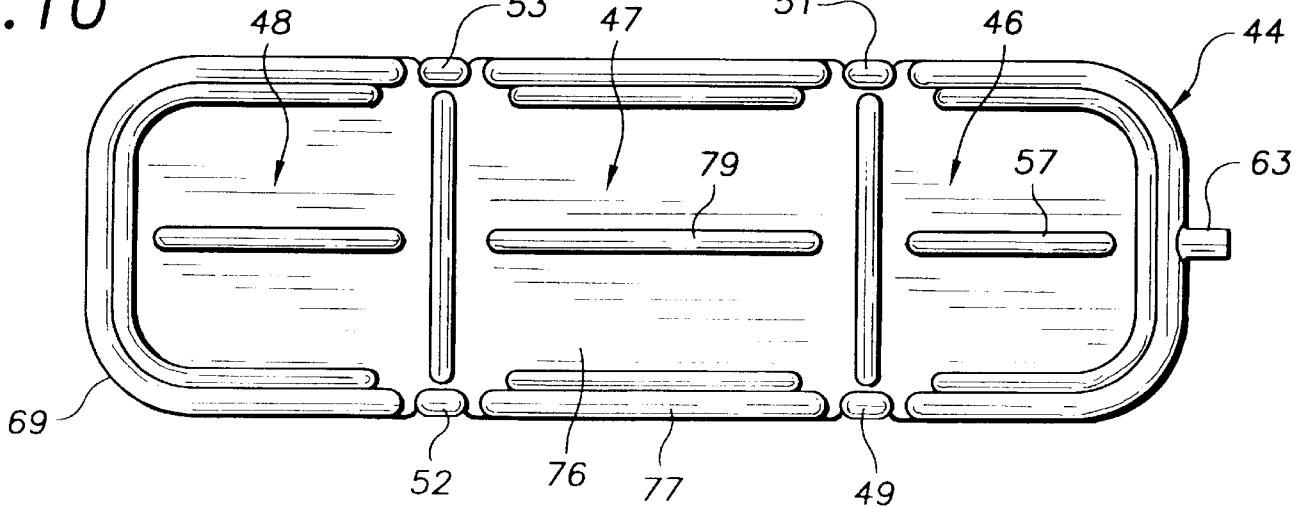
FIG. 10 is a bottom plan view of the air distributor of FIG. 5.

An air distributor, indicated generally at 44 in FIGS. 2, 3, and 5, located within chamber 24 on top of bottom 21 of bag 10 dispenses air into chamber 24. The air flows around the equipment and objects stored in bag 10 to remove moisture and odors from the equipment and objects. Air distributor 44 has three sections or manifolds' 46, 47 and 48. Hinge connectors 49 and 51 connect manifold 46 to central manifold 47. Manifold 48 is joined to manifold 47 with hinge connectors 52 and 53. Hinge connectors 49, 51 and 52, 53 allow end manifolds 46 and 48 to be moved upright adjacent the ends of bag 10 and folded side-by-side to facilitate shipping and storage.

Figure 11:
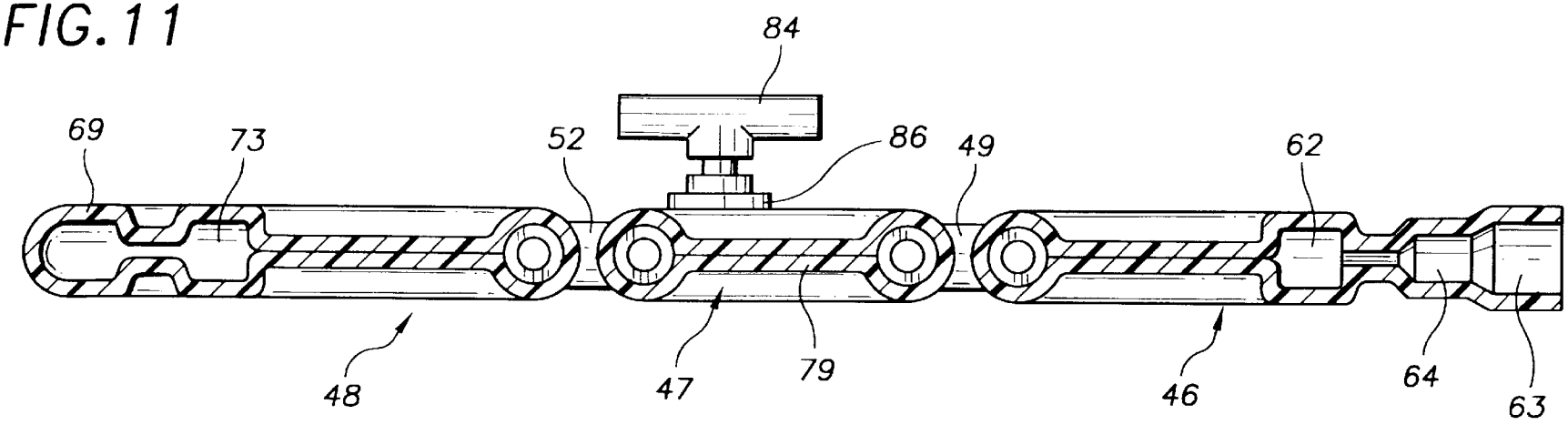
FIG. 11 is an enlarged sectional view taken along line 11—11 of FIG. 5.
Figure 12:
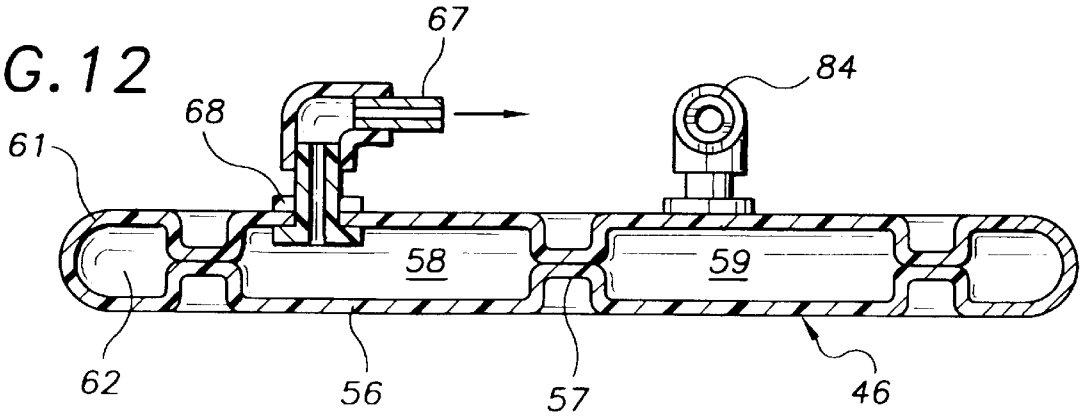
FIG. 12 is an enlarged sectional view taken along line 12—12 of FIG. 5.

Manifold 46, shown in FIG. 12, has a top wall 54 and a bottom wall 56 joined together along middle section 57 which separates air chambers 58 and 59. A U-shaped tubular edge 61 having an air passage 62 is joined to walls 54 and 56. An air inlet tube 63, shown in FIG. 11, having a passage 64 connected to tubular edge 61 directs air from blower 11 into air passage 62. Walls 54 and 56 and edge 61 are air impervious plastic members. The air blows from passage 62 through openings 63 into chambers 58 and 59 as shown in FIG. 11. Top wall 54 has a plurality of holes 66 open to chambers 58 and 59 for directing air from chambers 58 and 59 into bag chamber 24. Holes 66 are arranged in a generally square pattern adjacent the outer edge section of top wall 54 to allow air flow in the entire end of bag chamber 24.

Returning to FIGS. 5 and 12, a generally horizontal tubular member 67 in mounted on top wall 54 with a connector 68. Member 67 is used to support boots, shoes, skates, gloves, mittens, and equipment and direct air into these items to dry the interiors thereof. The tubular member can be located in a vertical position to allow gloves and mittens to be placed over the tubular member.

Manifold 48 has the same structure as manifold 46 with the exception of air inlet tube 63. A U-shaped tubular edge 69 surrounds a top wall 71 having a plurality of holes 72 for directing air into bag chamber 24. The interior of manifold 48 has two air chambers 73 which are charged with air from tubular edge 69. A horizontal tubular member 73 attached to top wall 71 with a connector 74 is used to direct air into hollow objects, such as gloves, skates, boots, shoes, mittens to dry the interiors thereof. Member 73 can be located in an upright position.

Figure 13:
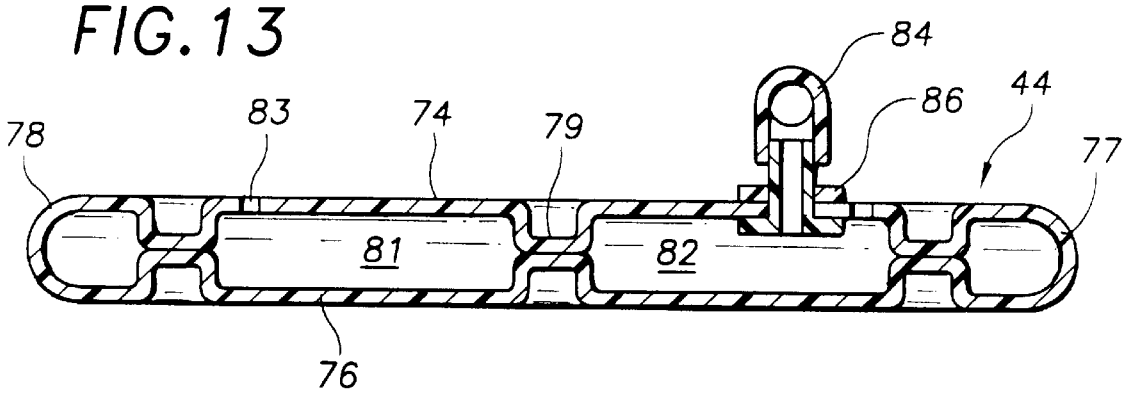
FIG. 13 is an enlarged sectional view taken along line 13—13 of FIG. 5.

As shown in FIG. 13, manifold 47 has a top wall 74 and bottom wall 76 joined to linear side tubular members' 77 and 78. The middle section 79 of walls 74 and 76 are joined to provide two air chambers 81 and 82. Top wall 74 has a plurality of holes 83 to allow air to flow from chambers 81 and 82 into the central portion of bag chamber 24. Returning to FIG. 5, holes 83 are arranged in a rectangular pattern adjacent the outer edge portions of top wall 74 to distribute air in the central area of bag chamber 24. A horizontal tubular member 84 mounted on top wall 74 with connector 86 has open opposite ends to direct air into hollow objects 85, such as skates, boots, shoes, mittens, gloves, helmets, and hats.

Figure 14:
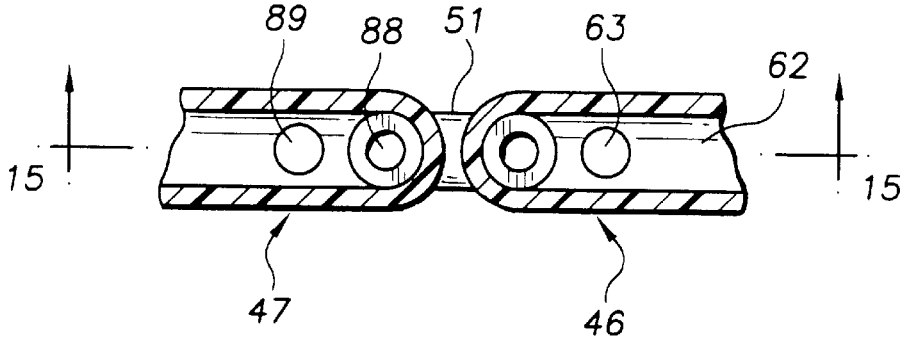
FIG. 14 is an enlarged sectional view taken along the line 14—14 of FIG. 5.
Figure 15:
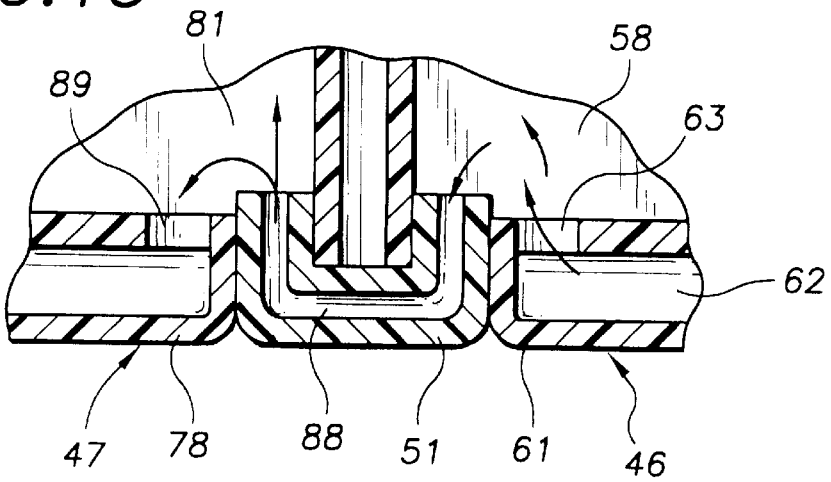
FIG. 15 is an enlarged sectional view taken along line 15—15 of FIG. 6.

Hinge connector 51, shown in FIGS. 14 and 15, is a U-shaped tubular member 87 having a passage 88 allowing air to flow from chamber 58 of manifold 46 into chamber 81 of manifold 47. The ends of tubular member 87 snap into lateral holes in manifolds 46 and 47 to allow manifolds 46 and 47 to pivot relative to each other. Hinge connectors 49, 52 and 53 have the same structure a hinge connector 51 to allow relative movement to manifolds 47 and 48. As shown in FIG. 15, air flows from passage 62 through hole 63 into air chamber 58. Air in chamber 58 flows through passage 88 in hinge connector 51 into chamber 81 of manifold 47 and out of chamber 81 through hole 89 into the passage of tubular member 78 leading to hinge connector 53. Connector 53 directs the air into the air chamber of manifold 48. Hinge connectors 49 and 52 also have passages that allow air to flow from manifold 46 into manifold 47 and out of manifold 47 into manifold 48.

In use, air distributor 44 is placed in bag 10 with the top walls 54, 71 and 74 of manifolds 46, 47 and 48 exposed to bag chamber 24 and equipment and objects stored in the chamber. Hose 12 connects blower 11 to air distributor 44 as shown in FIG. 1. Zipper 23 is closed to contain the equipment and objects in a closed environment. Blower 11 operated to move air through ozone producing unit 90 and hose 12 into air distributor 44. The air flow through holes 66, 74 and 83 in manifolds 46, 47 and 48 into bag chamber 24. The air flowing through chamber picks up moisture and odors from the equipment and objects in air chamber 24. The air in chamber 24 is forced through filters 31–34 which absorb odors and removes particulate from the air. The moisture ladened air is discharged into the atmosphere adjacent the top of bag 10. Ozone generator 91 continuously operates to produce ozone which is carried by the air flowing through casing 92 into passage 93. The ozone in manifolds 46, 47, and 48 destroys odors and bacteria that may be present and destroys odors, allergens, bacteria, molds and fungus in the bag chamber 24 and on equipment and objects stored in the bag chamber 24. A separate ozone producing unit located in bag chamber 24 can be used to generate ozone to control odors in the air in chamber 24 and on the equipment stored in chamber 24.

A modification of the travel and sports bag 100, shown in FIGS. 16 to 23, is equipped with an air distributor 144 operable to direct air into bag chamber 124 to dry equipment and objects in chamber 124. Air distributor 144 is coupled to an air blower or air pump 111 with a flexible hose 112. Blower 111 has a casing 113 enclosing an electric motor drivable connected to an impeller or fan 115 operable to force air through hose 112 into air distributor 144. A motor control 114 mounted on casing 113 includes a timer for operating the motor for a selected period of time. Blower 111 may include a heating element for heating the air discharged into hose 112. The air inlet of blower 111 is in communication with an interior chamber 176 of a casing 177. Casing 177 has air inlet openings 178 to allow air to be drawn into chamber 176 during operating of blower 111. An ozone generator 179 attached to casing 177 operate to discharge ozone into chamber 176. Blower 111 also draws air through ozone generator 179. Timer 114 is electrically connected to ozone generator to supply electric power to ozone generator 179 during operation of blower 111.

Bag 100 is a flexible canvas, plastic, or fabric container used to store and carry sport equipment, such as hockey pads, breezers, soccer, football, tennis, handball, and baseball objects. The moisture on the equipment in bag chamber 124 is removed by the air flowing through chamber 124 and filter 131. Bag 100 has side walls 116 and 117 joined to end walls 118 and 119 and bottom wall 121. Zipper or linear releaseable fasteners 123 are located longitudinally along the top of bag 100 to facilitate access to bag chamber 124 and permit equipment to be placed into and removed from bag chamber 124. A pair of straps 125 and 126 are secured to side walls 116 and 117. The upper portions of straps 125 and 126 extend above the top of bag 100 and provide a handle 127 used to carry bag 100. A second handle 130 secured to end wall 119 is used to lift and tow bag 100 using wheels 128. Brackets 129 secure wheels 128 to opposite lower portions of end wall 118.

Figure 22:
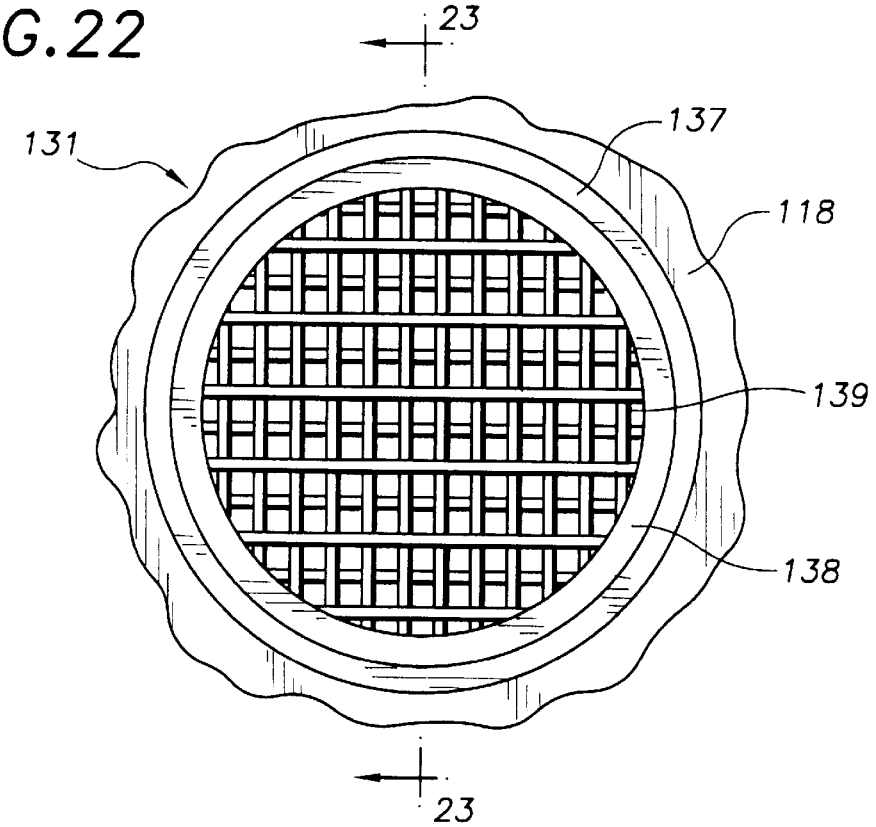
FIG. 22 is an enlarged plan view of the filter assembly attached to the end of the bag.
Figure 23:
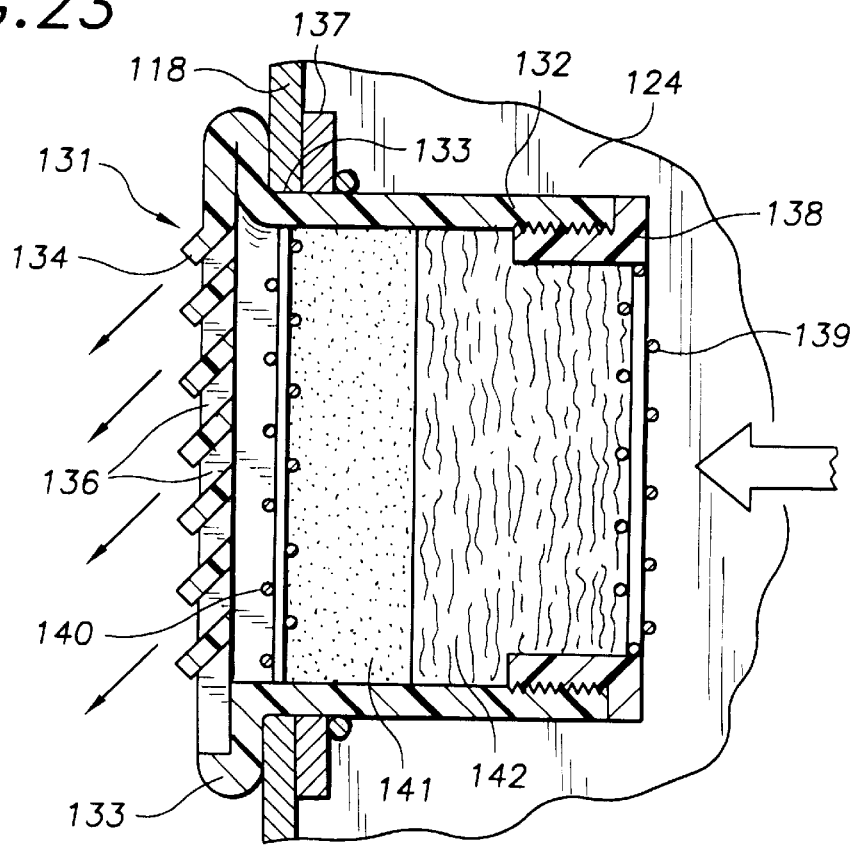
FIG. 23 is a sectional taken along line 23—23 of FIG. 22.

As shown in FIGS. 22 and 23, filter 131 has a cylindrical casing 132 extended through an opening 133 in end wall 118. Casing 132 has an annular outside flange 133 and spaced vanes 134 providing openings 136 to allow air to flow through casing 132. A washer or ring 137 clamps flange 133 to end wall 118 to hold filter on end wall 118. An annular sleeve 138 holding a grid or screen 139 is threaded into the inner end of casing 132. As second screen 140 is located adjacent the inside of vanes 140. The space between screens 139 and 140 accommodate filter materials including a bed of charcoal 141 and fiber material 142 for removing odors, particulates, and foreign materials from the air flowing through filter 131.

Figure 18:
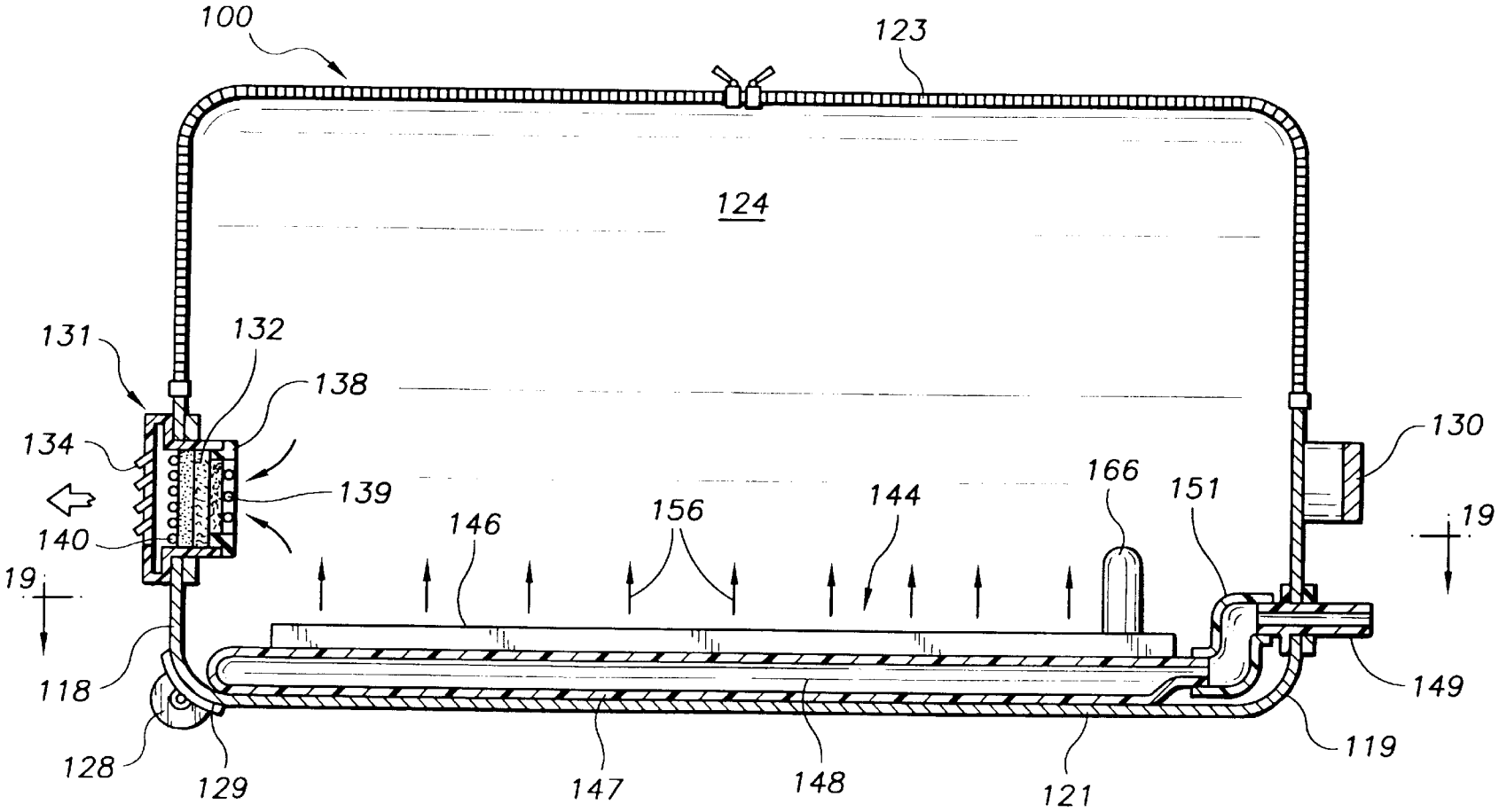
FIG. 18 is an enlarged sectional view taken along line 18—18 of FIG. 17.
Figure 19:
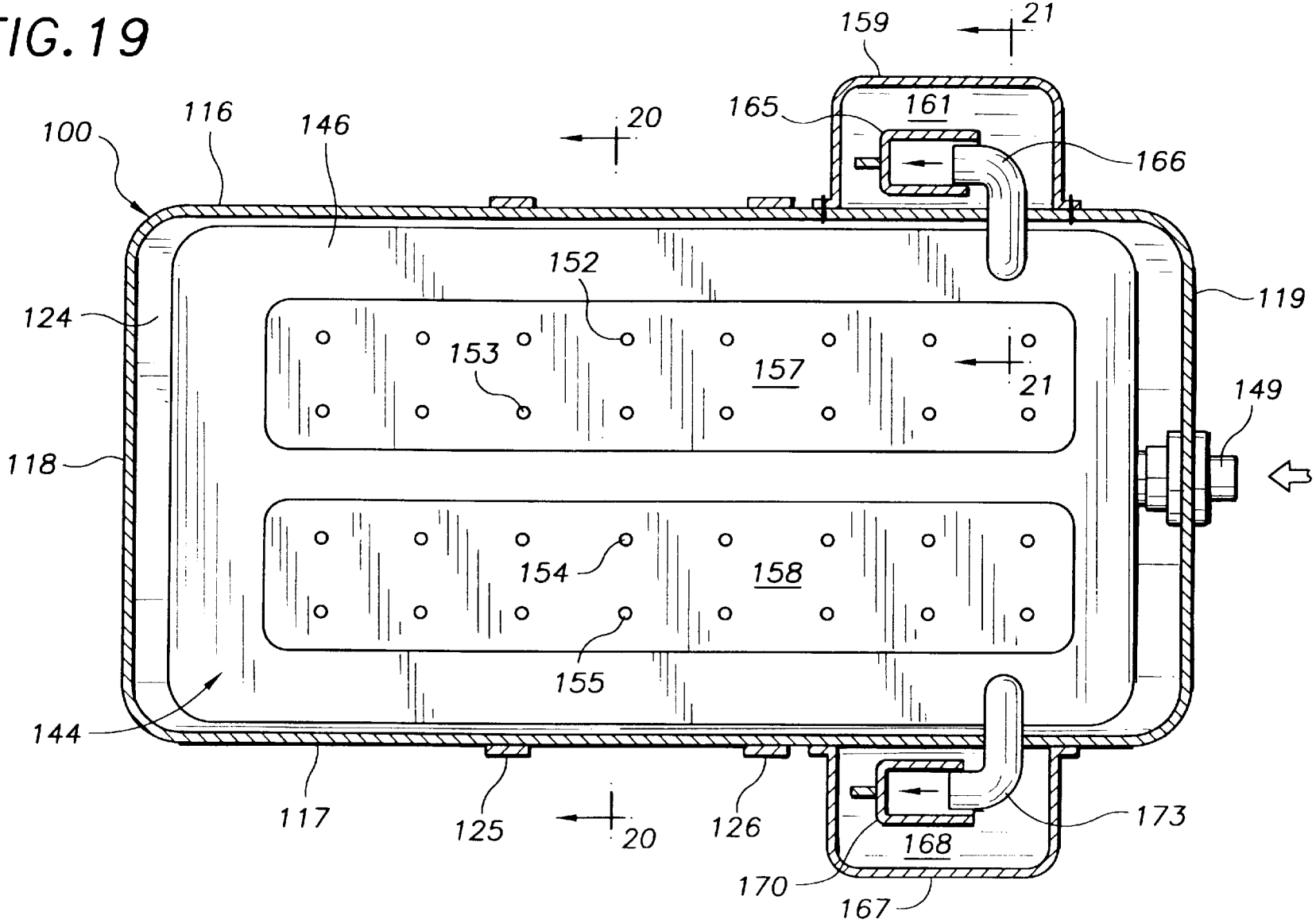
FIG. 19 is a sectional view taken along line 19—19 of FIG. 18.
Figure 20:
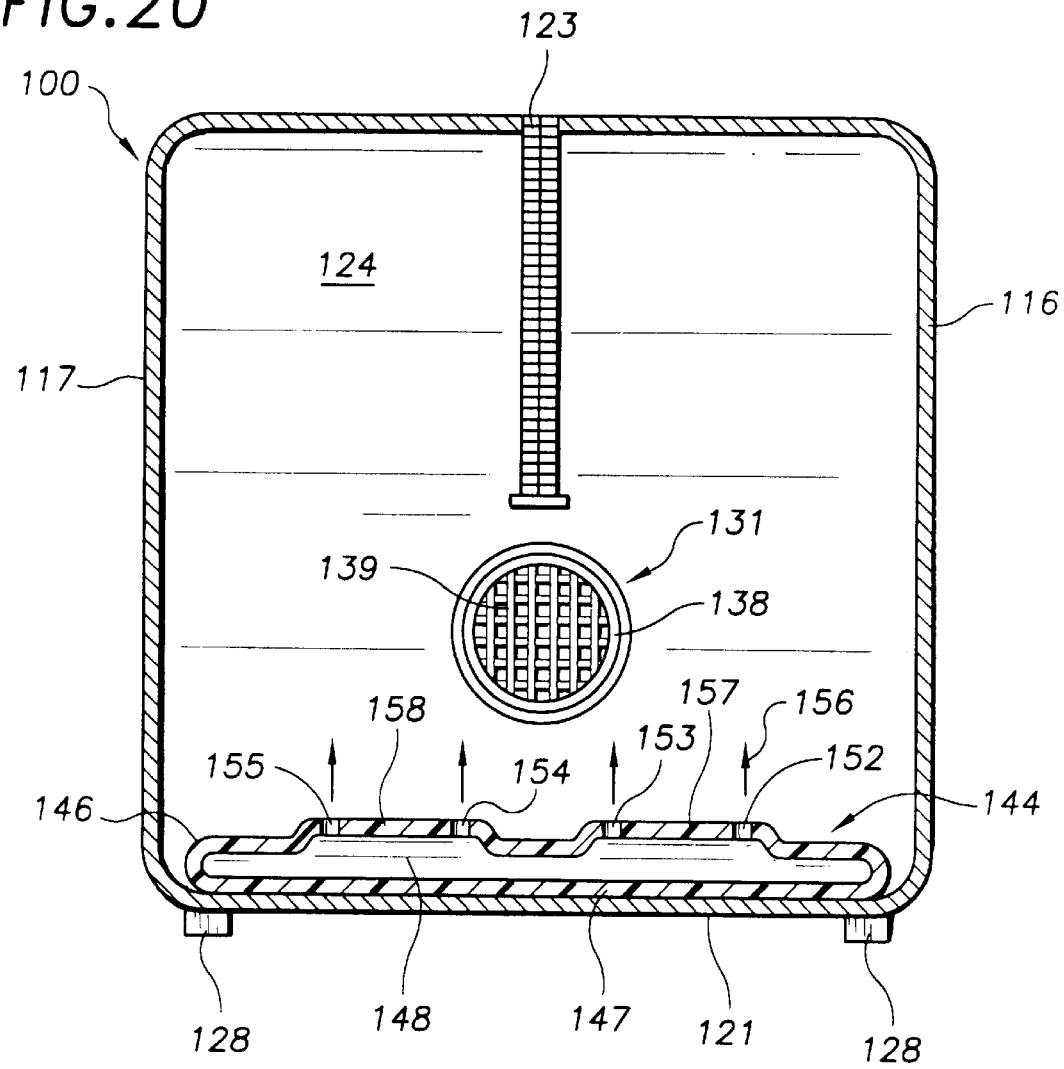
FIG. 20 is a sectional view taken along line 20—20 of FIG. 19.
Figure 21:
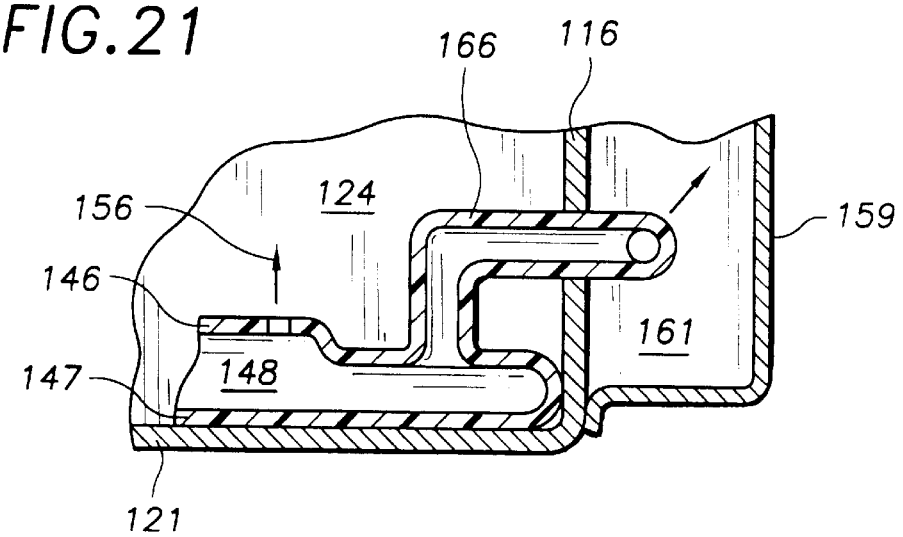
FIG. 21 is an enlarged sectional view taken along line 21—21 of FIG. 19.

Air distributor 144, shown in FIGS. 18, 19 and 20, is a generally rectangular manifold located on the bottom wall 121 of bag 100. Air distributor 144 has a top wall 146, a bottom wall 147 and an interior chamber 148. An air inlet tube 149 is attached to an end of distributor 144 adjacent wall 119 with a hose 151. Tube 149 projects through end wall 119 to accommodate hose 112 thereby allowing air to flow into manifold chamber 148. Top wall 146, as shown in FIGS. 19 and 20, has a plurality of rows of holes 152, 153, 154 and 155 open to bag chamber 124 to allow air to flow into bag chamber 124 as indicated by arrows 156 in FIGS. 18 and 20. Holes 152 and 153 are located in a raised rectangular section 157 of top wall 146. A second raised rectangular section 158 has holes 154 and 156.

A first pocket 159 secured to side wall 116 has a chamber 161 for storing a hollow object 165, such as a shoe, boot, or ice skate. The top of pocket 159 holds an air filter 164 to allow air to flow through pocket chamber 161. A curved tube 166 attached to air distributor 144 carrier air to pocket chamber 161 to dry the interior of hallow items, such as ice skates placed over the outer end of tube 166.

A second pocket 167 secured to side wall 117 has a chamber 168 for storing a hollow object 170, such as a boot, shoe or ice skate. A flap 169 and zipper 171 closes the top of pocket 167. An air filter 172 mounted on pocket 167 removes odors and foreign material from the air flowing through the filter 172. A curved tube 173 attached to air distributor 144 carries air into pocket chamber 168 to dry hollow objects placed on the end tube 173. The air in pocket chambers 161 and 168 can be routed back into bag chamber 124. This eliminates the need for filters 164 and 172 as the air flows through bag filters 31, 32, 33 and 34 into the external atmosphere.

In use, blower 111 is connected with hose 112 to air inlet tube 149 whereby the blower discharges a stream of air into air distributor chamber 148. Blower 111 draws air from chamber 176 of casing 177 and ozone generator 179. The ozone and air mix in chamber 176. Blower fan 115 rotated with an electric motor (not shown) draws ozone and air from chamber 176 and discharges the ozone and air into hose 112 which carries the ozone and air to air distributor 144 located in bag 100. The air flows through the rows of holes 152–155 into bag chamber 124. The air moving through bag chamber 124 picks up moisture and odors from the equipment in the bag chamber 124. The ozone moving through bag chamber 124 destroys odors, allergens, bacteria, molds and fungus in chamber 124 and on equipment and objects stored in chamber 124. Filter 131 removes odors and particulates from the air flowing through the filter to the environment adjacent bag 100. Air also flows through pocket chambers 161 and 168 to remove moisture from objects 165 and 170 located in the pockets 159 and 167. Filters 164 and 172 remove odors and foreign materials from the air flowing out of pocket chambers 161 and 168.

As shown in FIGS. 24 to 29, ozone deodorizer is an apparatus herein termed an ozone generator unit that operates to produce ozone using an electric transformer to convert standard 110 A.C. power to D.C. power to operate an ozone electronic producer. The apparatus also operates on D.C. power from one or more batteries. A three way switch is used to select OFF, turning the unit completely off, A.C. switch will run the unit on A.C. power or battery switch will run the unit on D.C. battery power. The ozone generator unit is also designed to use a rechargeable battery that will charged whenever it is plugged into a conventional 110 A.C. outlet even when the unit is being run on the A.C. mode. The ozone generator unit has a male electrical plug mounted at surface level to the back side of a case. The back of the case also has Velcro or other type anchoring means to attach the apparatus to a support. A male electrical plug and Velcro anchors match in location to the female electrical receptacle and the Velcro anchors mounted on a surface of a blower used to provide air for a portable dryer.

Figure 16:
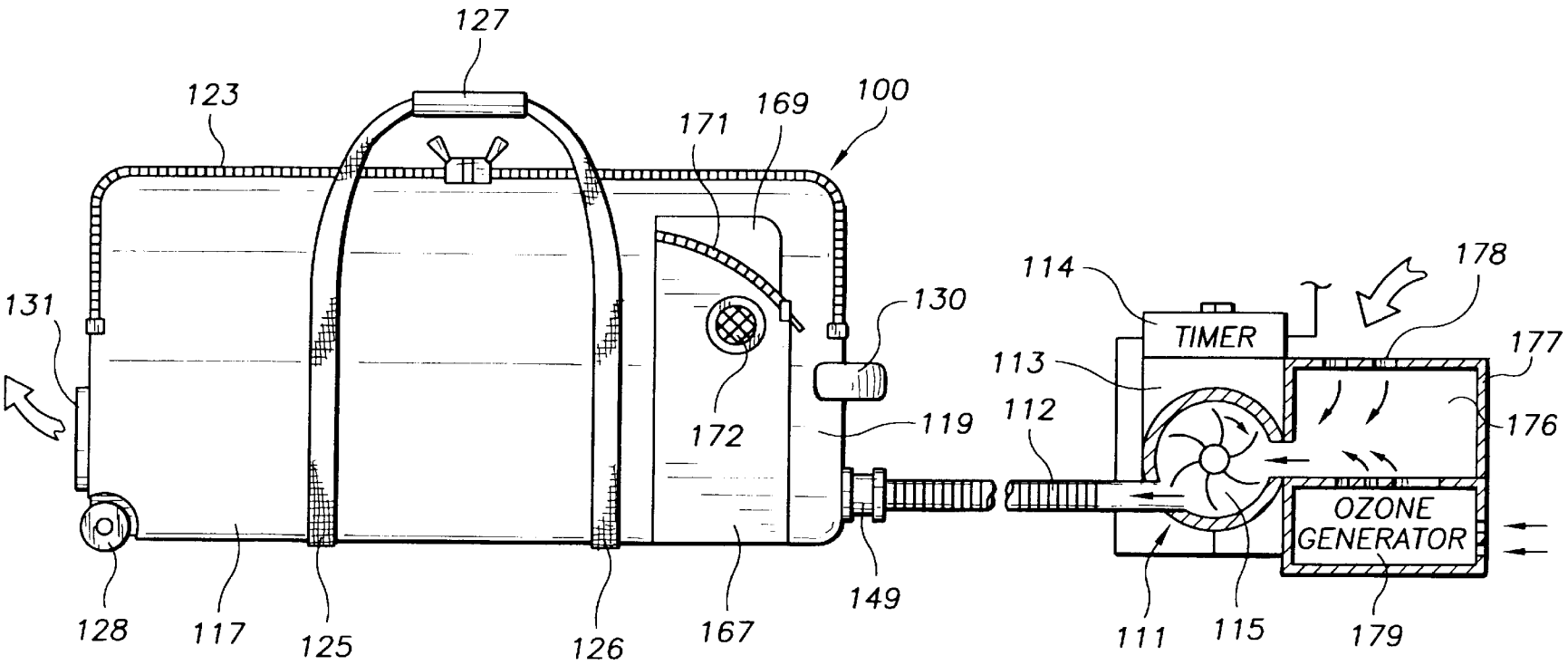
FIG. 16 is a side elevational view of a modification of the travel and sport equipment bag having an air distributor of the invention connected to an air blower and ozone generator.
Figure 17:
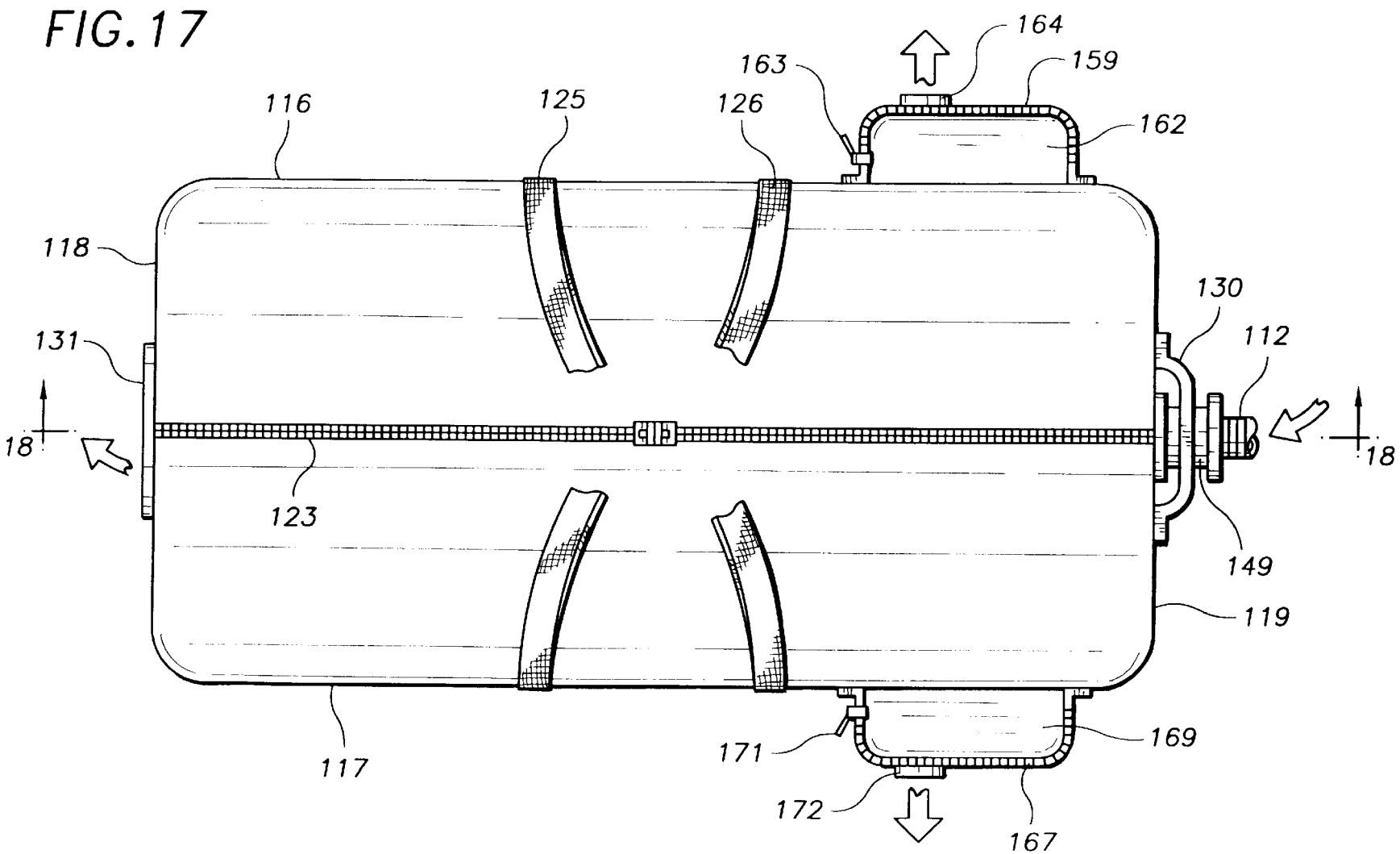
FIG. 17 is an enlarged top plan view of the bag of FIG. 16.

The blower unit starts and stops by means of a timer. When the blower unit is ON, the blower motor sucks air into an air intake port and exhausts air to a dryer type of duct to provide air flow into the dryer. The blower motor is powered by standard 110 A.C. power. When the blower unit is ON, power will be provided to the female electrical receptacle. The male plug mounted on the back side of the portable ozone producer can be plugged directly into the blower unit's female receptacle. The matching Velcro anchor will hold the ozone generator unit in place. When the ozone generator unit switch is in the ON position, it will run when the timer on the blower unit is turned ON so that ozone is produced during the time that the blower unit operates to discharge air. When both units are running, ozone is discharged through the vented top end of ozone generator unit. The ozone is sucked into the air intake port of the blower unit and discharged into the portable dryer. The ozone rich air deodorizes the clothes or equipment being dried in the portable dryer as well as decontaminates the air and exhaust filters. The ozone deodorizes and kills mold, mildew, germs, bacteria and many spores. The portable ozone generator unit can be easily removed from the blower unit. The ozone generator unit can be used in other drying units, such as an armoire disclosed in U.S. Pat. Nos. 5,546,678 and 5,369,892. This unit will have similar receptacle and anchor system to power and turn on the ozone generator unit when the dryer is running. The ozone generator unit can also be placed inside sports bags for deodorizing and equipment protection during storage. Examples of bags for storing equipment and objects is shown in FIGS. 1 and 16.

The ozone generator unit has a rotating hook used to retain the ozone generator unit in a closet or room to get rid of musty smells from the storage, or smoke odor absorbed by clothes at a night club or restaurant. The ozone generator unit can be hung up in a locker, such as used in a gym or spa. This will reduce odor of work out clothes, tennis shoes, and equipment as well as keeping the locker fresh so street clothes will not pick up unwanted odors while hung up in the locker. The ozone generator unit has a clip to anchor the unit to car visors. With the battery capability the ozone generator unit can be used to deodorize a car or any other places where odor is a problem. The portable ozone generator unit can be used in the bathroom or kitchen by simply plugging the unit into any A.C. outlet receptacle by turning the switch to the ON position. The switch is turned to the OFF position when not in use. Though this portable ozone generator unit is designed as an optional feature for use with my various dryers, there are many uses and applications for a portable ozone generator unit.

Figure 24:
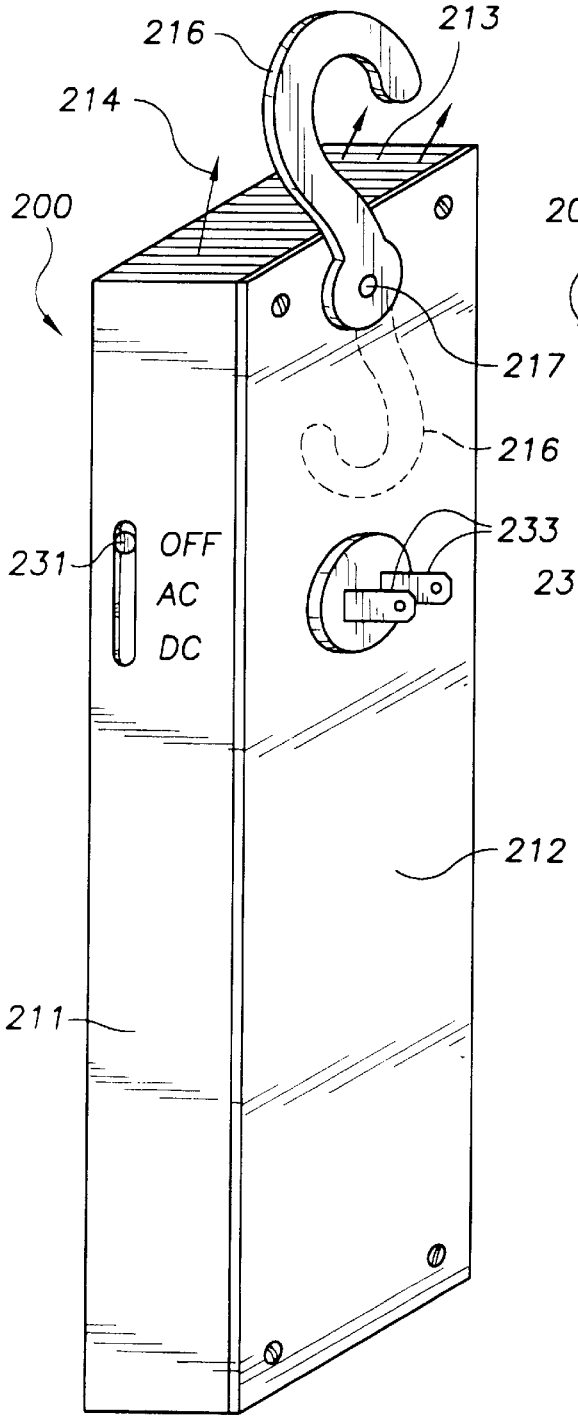
FIG. 24 is a rear elevational view of the ozone deodorizer of the invention.

The ozone generator 200, shown in FIG. 24, has a rectangular case 211 with a removable back panel 212. The top of case 211 has an open grid 213 to allow air and ozone 214 to flow away from case 211. A hook 216 is pivotally connected with a bolt or pin 217 to the top of panel 212. Hook 216 is used to support ozone deodorizer 200 on a horizontal member, such as a rod in a clothes closet or locker to retain deodorizer 200 in a select location.

Figure 25:
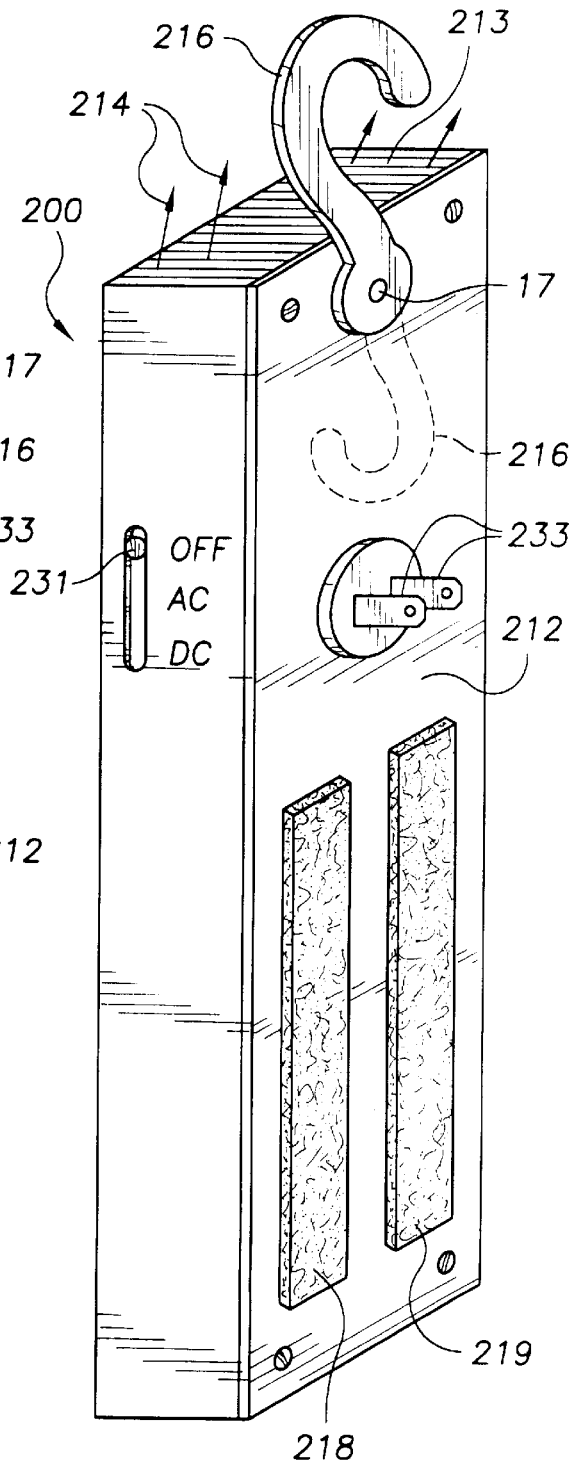
FIG. 25 is a rear elevational view of a first modification of the ozone deodorizer of FIG. 24.

As shown in FIG. 25, a pair of vertical hook strips 218 and 219 are secured to panel 212. Strips 218 and 219 have hook fibers that grip on loop fibers known as Velcro fasteners. An adhesive secures the back of strips 218 and 219 to the outside of panel 212.

Figure 26:
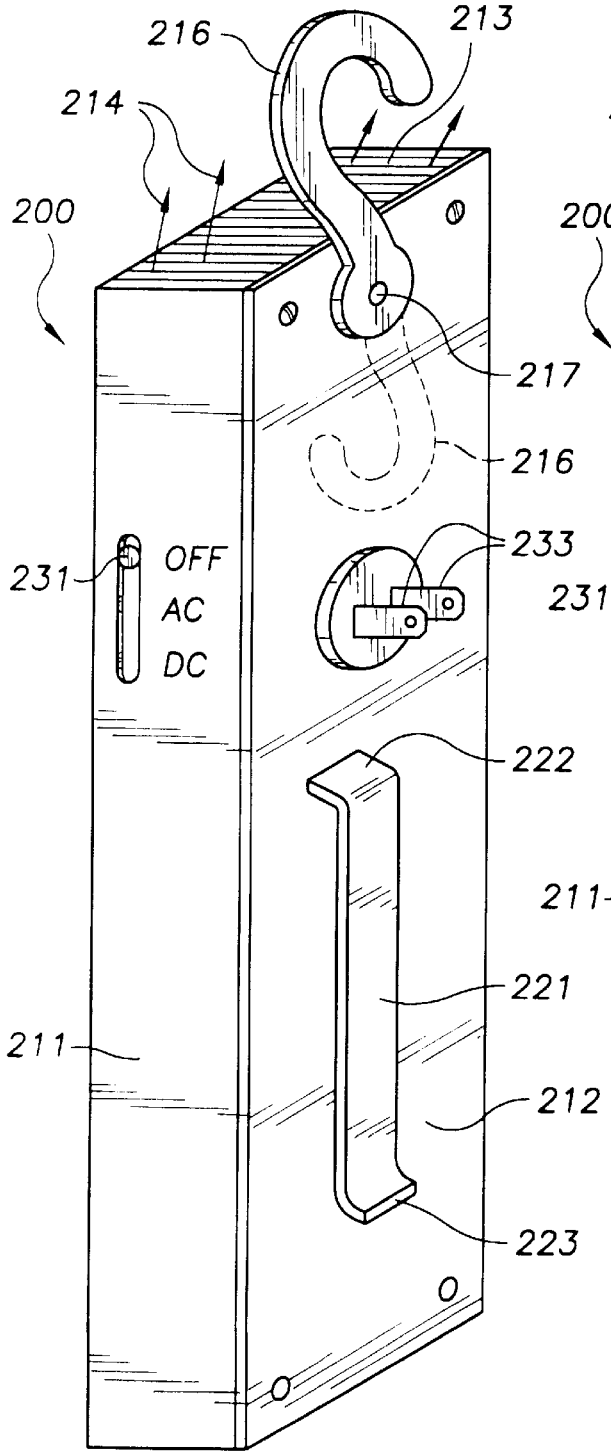
FIG. 26 is a rear elevational view of a second modification of the ozone deodorizer of FIG. 24.

As shown in FIG. 26, a vertical clip 221 has an upper end 222 secured to a middle portion of panel 212 and an outwardly turned lower end 223. Clip 221 is used to hold deodorizer 200 on a flat support, such as a sun visor of a motor vehicle. Clip 221 can retain deodorizer 200 on a person's belt, pocket, shirts and coats.

Figure 27:
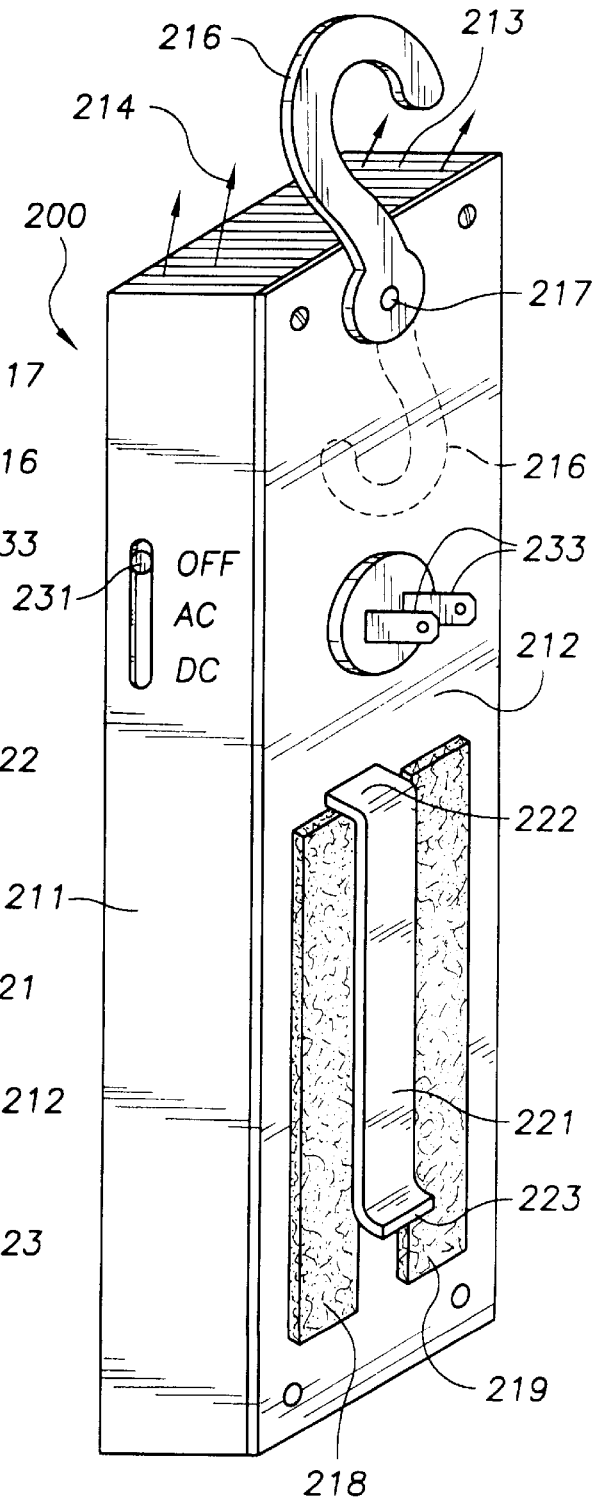
FIG. 27 is a rear elevational view of a third modification of the ozone deodorizer of FIG. 24.

As shown in FIG. 27, a single panel 212 can be provided with hook 216, hook strips 218 and 219 and clip 221. This allows deodorizer 200 to be used in different locations without changing panel 212.

Figure 28:
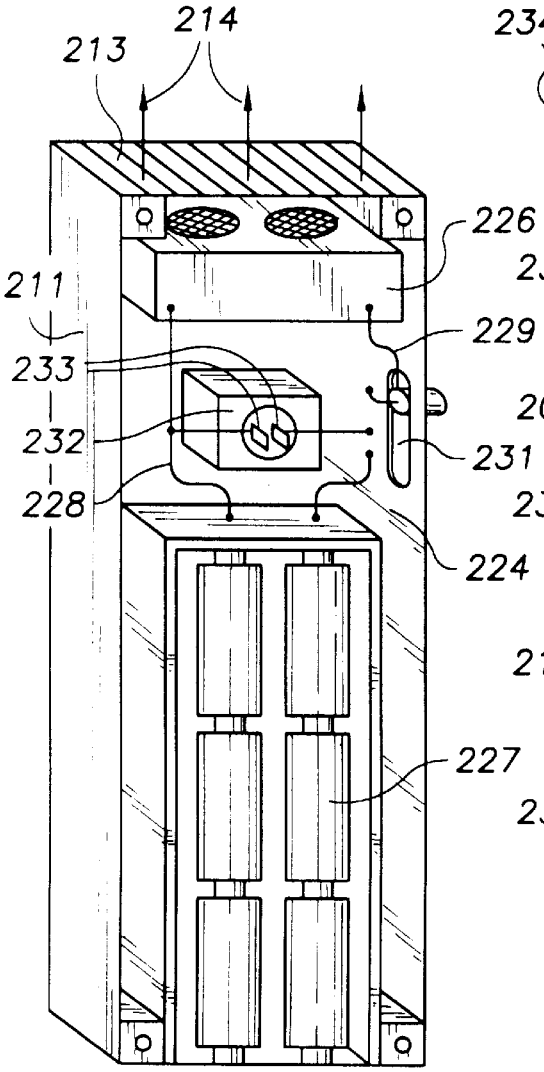
FIG. 28 is a rear elevational view of the ozone deodorizer of FIG. 24 with a back panel removed diagrammatically showing the operating components of the ozone deodorizer.

As shown in FIG. 28, case 211 is a box-shaped housing having an internal chamber 224. An ozone producer 226 is located in chamber 224 adjacent the inside of grid 213. Ozone producer 226 generates a triatomic form of oxygen with high voltage electronics. The ozone flows with air into the environment surrounding the case 211 and functions to disinfect and deodorize air and objects in this environment.

Ozone producer 226 is connected to an electric D.C. power supply 227 comprising batteries connected in series. Conductor lines 228 and 229 electrically couple power supply 227 to ozone producer 226. A three way switch 231 in line 229 connects ozone products 226 to power supply 227 or an A.C. to D.C. adapter 232. Adapter 232 has a pair of prongs or fingers 233 for connecting adapter 232 to conventional A.C. electric power.

Figure 29:
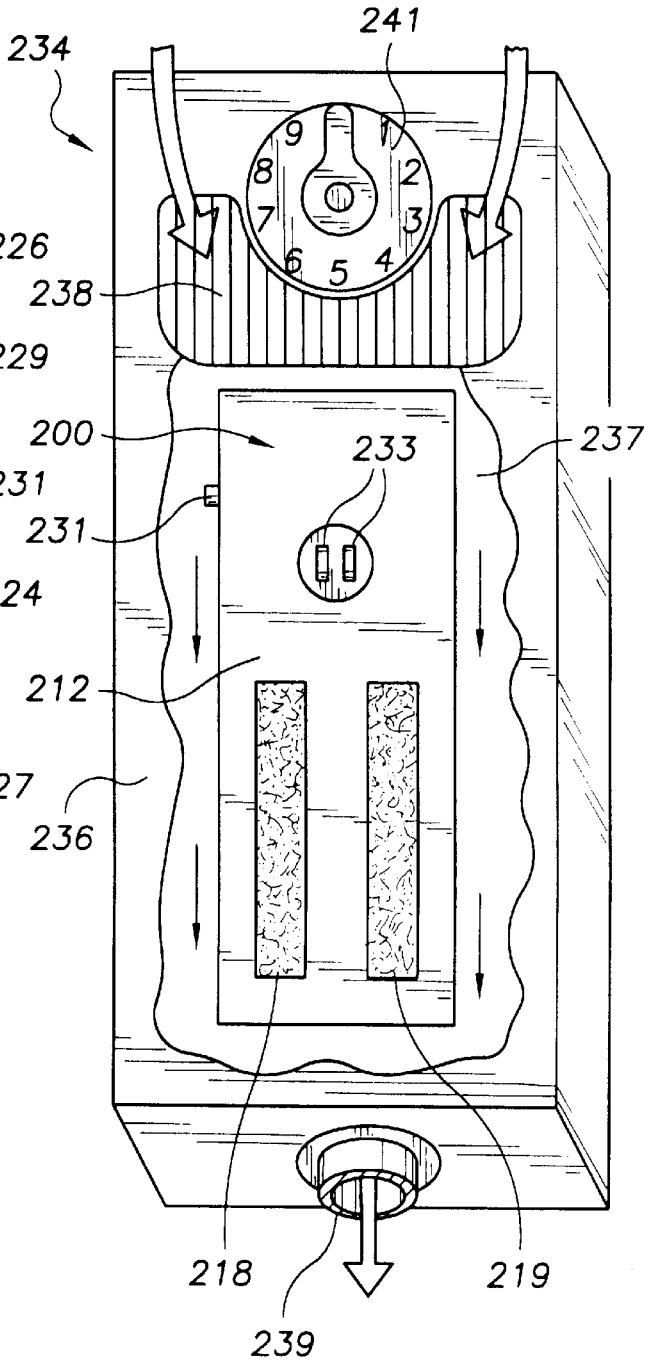
FIG. 29 is a perspective view of an air blower accommodating the ozone deodorizer of FIG. 25.

As shown in FIG. 29, ozone deodorizer 200 is located within an air blower 234 having a housing 236 surrounding an interior chamber 237. The front of housing 236 has an air intake panel 238 located in front of fan or air blower (not shown). The fan draws air through intake panel 238, moves air through chamber 237, and discharges air and ozone into a hose or conduit 239. Hose 239 can be connected to a dryer, such as a bag container, housing or cabinet used to dry objects and clothing. The motor for driving the fan is connected to an ON/OFF timer 241. The electric power supply for the motor can also be used to supply power top ozone producer 226 so that ozone is produced when the motor operates the fan.

The bag herein described are elongated horizontal sport and equipment bags. The bags of the invention can have an upright or vertical orientation having tops that include hanger bars to hold the bags on a fixed rod or support. The air distributors including upright air tubes are located at the bottom of the bags. One or more of the walls of the bags have zippers or other releaseable fasteners that allow equipment and clothing to be placed in and removed from the interiors of the bag. Blowers and air pumps are used to supply air to the bags. Filters mounted on the bags remove odors and foreign materials from the air moving through the filters into the external atmosphere.

While there has been shown and descried preferred embodiments of the bag, air distributor, ozone generators and air filters of the invention, it is understood that changes in the structures, materials, and arrangement of structures can be made by a person skilled in the art without departing from the invention. The invention is defined in the following claims.

What is claimed is:

1. An apparatus for drying objects and negating bacteria, molds and fungus comprising: a bag having an interior chamber for accommodating objects, ozone generator means for creating ozone, timer means connected to the ozone generator means for controlling the duration of operation of the ozone generator means to limit the amount of ozone created by the ozone generator means, said air distributor means located within the interior chamber of the bag, means connected with the ozone generator means and the air distributor means for moving air and ozone to the air distributor means, said air distributor means having chamber means for accommodating air and ozone, first means in communication with the chamber means to allow air from the means for moving air and ozone into the chamber means, second means to allow air and ozone to flow from the chamber means into the interior chamber of the bag to dry objects in the interior chamber and negate bacteria, molds and fungus in the interior chamber, and third means mounted on the bag to allow air to flow from the interior chamber of the bag to the environment adjacent the bag.

2. The apparatus of claim 1 wherein: the bag has a bottom wall, said air distributor means being located on said bottom wall with said second means directed away from the bottom wall to direct air and ozone upward into the interior chamber of the bag, and closure means secured to the bag operable to provide access to the interior chamber of the bag.

3. The apparatus of claim 1 wherein: the first means is a tubular member open to the chamber means, said tubular member having a portion extended through the bag and connected to the means for moving air and ozone.

4. The apparatus of claim 3 including: blower means operable to generate a stream of air, said ozone generator means being associated with the blower means to provide ozone for the stream of air, and means connected to the blower means and tubular member to carry air and ozone from the blower means to the tubular member and chamber means of the air distributor.

5. The apparatus of claim 1 wherein: the air distributor means has a wall facing the interior chamber of the bag, said second means comprising holes in said wall to allow air and ozone to flow from the chamber means of the air distributor to the interior chamber of the bag to dry objects in the bag.

6. The apparatus of claim 1 wherein: the air distributor means has at least two manifolds, means for movably connecting the manifolds to allow movement of the manifolds relative to each other, and means to carry air and ozone between the manifolds, said second means including holes in the manifolds to allow air and ozone from the manifolds into the interior chamber of the bag.

7. The apparatus of claim 1 wherein: the bag includes pocket means having pocket chambers for accommodating objects to be dried, said second means including tubular means for carrying air and ozone from the chamber means into the pocket chambers to dry objects located within the pocket chambers.

8. The apparatus of claim 1 including: wheel means secured to one end of the bag for supporting the bag on a surface, and handle means secured to the other end of the bag to facilitate transport of the bag on said surface.

9. An apparatus for drying objects comprising: a container having an interior chamber for accommodating objects, a device for generating ozone, control means connected to the device for regulating the duration of operation of the device for regulating the duration of operation of the device to limit the amount of ozone generated by the device, air distributor means located within the interior chamber of the container, said air distributor means having chamber means for accommodating air and ozone, first means to allow air from a supply of air and ozone from the device to flow into the chamber means, second means to allow air and ozone to flow from the chamber means into the interior chamber of the container to dry objects in the interior chamber and destroy bacteria, molds and fungus in the interior chamber, and means to allow air to flow from the interior chamber of the container to the environment adjacent the container.

10. The apparatus of claim 9 wherein: the container has a bottom wall, said air distributor means being located on said bottom wall with said second means directed away from the bottom wall to direct air and ozone upward into the interior chamber of the container and closure means secured to the container operable to provide access to the interior chamber of the container.

11. The apparatus of claim 9 wherein: the first means is a tubular member open to the chamber means, said tubular member having a portion extended through the container.

12. The apparatus of claim 9 wherein: the air distributor means has a wall facing the interior chamber of the container said second means comprising holes in said wall to allow air and ozone to flow from the chamber means of the air distributor to the interior chamber of the container to dry objects in the bag.

13. The apparatus of claim 9 wherein: the air distributor means has at least two manifolds, means for movably connecting the manifolds to allow movement of the manifolds relative to each other, and means to carry air and ozone between the manifolds, said second means including holes in the manifolds to allow air and ozone from the manifolds into the interior chamber of the container.

14. The apparatus of claim 9 wherein: the container includes pocket means having pocket chambers for accommodating objects to be dried, said second means including tubular means for carrying air and ozone from the chamber means into the pocket chambers to dry objects located within the pocket chambers and destroy bacteria, molds and fungus in the pocket chambers.

15. An apparatus for drying objects comprising: a bag having a bottom wall, an interior chamber for accommodating objects, operable to provide access to the interior chamber of the bag, ozone generator means creating ozone, timer means connected to the ozone generator means for controlling the duration of operation of the ozone generator means to limit the amount of ozone created by the ozone generator means, air distributor means in the interior chamber located on said bottom wall for directing air and ozone into the interior chamber, blower means connected to the ozone generator means and air distributor for moving air and ozone into the air distributor means, said air distributor means having a top wall facing said interior chamber and chamber means for accommodating air and ozone tubular means extended upwardly from the top wall for supporting an object in the interior chamber, said tubular means having a passage open to the interior chamber of the bag and the chamber means for allowing air and ozone to flow from the chamber means to the object supported on the tubular means and the interior chamber of the bag, means mounting the tubular means on the top wall of the air distributor means whereby the top wall and tubular means support the object in the interior chamber of the bag, first means connected to the means for moving air to allow ozone and air under pressure to flow into the chamber means, the ozone and air in the chamber means flows through the passage of the tubular means to the object on the tubular means to dry said object and the interior chamber of the bag and destroy bacteria, molds and fungus in the bag and objects in the bag, and second means to allow air to flow from the interior chamber of the bag to the environment adjacent the bag.

16. The apparatus of claim 15 wherein: said top wall of the air distributor means has a plurality of holes to allow air and ozone to flow from the chamber means into the interior chamber of the bag to dry objects located in the interior chamber of the bag.

17. The apparatus of claim 15 including: wheel means secured to one end of the bag for supporting the bag on a surface, and handle means secured to the other end of the bag to facilitate transport of the bag on said surface.

18. The apparatus of claim 15 including: straps secured to the bag providing handles to manually carry the bag containing the objects.

19. The apparatus of claim 15 wherein: the means to allow ozone and air to flow from the interior chamber of the bag includes filter means mounted on the bag to remove odors from the air flowing through the filter means to the environment adjacent the bag.

20. The apparatus of claim 19 wherein: the filter means includes charcoal means and porous material for removing odors, particulates and foreign materials from the air flowing through the charcoal means and porous material.

21. A method of removing moisture and odors from objects and storing the objects in a bag having an enclosed interior chamber and an air distributor having chamber means for accommodating air and providing passages to allow air to flow from the chamber means into the interior chamber of the bag comprising:

confining the objects within the enclosed interior chamber of the bag, generating ozone, controlling the duration of generating ozone, introducing air and ozone into the chamber means of the air distributor, dispensing air and ozone from the air distributor into the interior chamber through the passages of the air distributor to remove moisture and odors from the objects located in the chamber, and destroy bacteria, molds and fungus in the chamber of the bag and objects in the chamber, exhausting air from the chamber into the environment, filtering the air exhausting from the interior chamber to remove foreign matter from the air exhausted into the environment, storing the dried objects in the interior chamber of the bag, and transporting the bag with the stored dried objects to selected location.

22. The method of claim 21 including: heating the air introduced into the chamber means of the air distributor.

23. The method of claim 21 including: storing an object in a second chamber in the bag separated from the enclosed interior chamber, and directing air and ozone from the passage of the air distributor into the second chamber to remove moisture and odors from the object in the second chamber, and exhausting air from the second chamber.

24. The method of claim 23 including: filtering the air exhausting from the second chamber to remove odors from the air exhausting from the second chamber.

25. The method of claim 21 including: supporting an object on a tubular member mounted on the air distributor and extended into the interior chamber of the bag, and directing air and ozone from the chamber means through the tubular member to the object on the tubular member to dry the object on the tubular member.

* * * * *